US006929824B2

(12) United States Patent
Baker

(10) Patent No.: US 6,929,824 B2
(45) Date of Patent: Aug. 16, 2005

(54) METHOD OF MAKING A MATERIAL

(75) Inventor: Julie Baker, Watford (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/687,331

(22) Filed: Oct. 16, 2003

(65) Prior Publication Data

US 2004/0091626 A1 May 13, 2004

(30) Foreign Application Priority Data

Nov. 12, 2002 (GB) ..... 0226309

(51) Int. Cl.[7] ..... B05D 5/00
(52) U.S. Cl. ..... 427/244
(58) Field of Search ..... 427/243, 244

(56) References Cited

U.S. PATENT DOCUMENTS 3,794,548 A * 2/1974 Wirth et al. ..... 428/91
4,657,938 A 4/1987 Fithian et al.
5,356,853 A 10/1994 Ueno et al.
6,228,476 B1 * 5/2001 Bogrett et al. ..... 428/306.6
2001/0021726 A1 9/2001 Brown

FOREIGN PATENT DOCUMENTS

| | | |
|---|---|---|
| EP | 0 816 113 | 1/1998 |
| EP | 1 315 032 | 5/2003 |
| EP | 1 388 609 | 2/2004 |

OTHER PUBLICATIONS

Daniel Klempner and Kurt C. Frisch; Chapter 17: Blowing Agents for Polymer foams, Section 3 chemical bklowing Agents (chapter written by Dr. Fyodor A. Shutov); 1991.

* cited by examiner

*Primary Examiner*—Erma Cameron
(74) *Attorney, Agent, or Firm*—Frank Pincelli

(57) ABSTRACT

A method of making a material comprises the steps of coating a support with a solution, the solution comprising a polymer and at least one blowing agent. Activation of the blowing agent is prevented until after coating.

3 Claims, 1 Drawing Sheet

20μm

20μm

20μm

METHOD OF MAKING A MATERIAL

CROSS REFERENCE TO RELATED APPLICATIONS

This is a U.S. original patent application which claims priority on Great Britain patent application No. 0226309.3 filed Nov. 12, 2002.

FIELD OF THE INVENTION

This invention relates to a method of making a material, in particular to a method of making a foamed polymeric material suitable for use as an inkjet printing medium.

BACKGROUND OF THE INVENTION

Inkjet printing is a process in which a stream of ink, preferably in the form of droplets, is ejected at high speed from nozzles against a medium so as to create an image.

Media used for inkjet recording need to be dimensionally stable, absorptive of ink, capable of providing a fixed image and compatible with the imaging materials and hardware.

Most commercial photo quality inkjet media can be classified in one of two categories according to whether the principle component material forms a layer that is porous or non porous in nature. Inkjet media having a porous layer are typically formed of inorganic materials with a polymeric binder. When ink is applied to the medium it is absorbed into the porous layer by capillary action. The ink is absorbed very quickly but the open nature of the porous layer can contribute to the instability of printed images, particularly when the images are exposed to environmental gases such as ozone.

Inkjet media which have a non porous layer are typically formed of one or more polymeric layers that swell and absorb the applied ink. Due to the limitations of the swelling mechanism this type of media is slow to absorb the ink. However, once dry the printed images are often stable when subjected to light and ozone.

Alternatives to pure "porous" or "non porous" media are hybrids which take the merits of each pure medium. These hybrids have swellable porous layers. One such media is created from foamed polymer layers using a swellable hydrophilic polymer and blowing agents. This results in the formation of voids in the polymer layer which lead to improved absorption of the ink. Instead of the ink being held in pores which are located in-between particles, as in conventional porous media, the ink is located within the polymer. This results in improved image stability.

U.S. patent application Ser. No. 10/631,236 discloses an inkjet printing medium formed by a foamed polymeric layer. This medium may be created by the use of blowing agents.

It has been found that when blowing agents are added to the coating solutions prior to coating the surface of the final foamed polymeric inkjet media is quite rough. This is due to gas bubbles present in the melt, and therefore in the coating, acting as nucleation sites for further bubbles to form around. Coating quality can also be poor due to the pre-formed gas bubbles passing down the hopper slide. These gas bubbles cause lines, streaks and edge retraction.

It is an aim of the invention to provide a method of improving the surface characteristics and/or coating quality of a foamed polymeric material.

SUMMARY OF THE INVENTION

According to the present invention there is provided a method of making a material comprising the steps of coating a support with a solution comprising a polymer and at least one blowing agent, activation of the blowing agent being prevented until after coating.

The invention further provides a material formed by the method described above, in particular an inkjet printing/recording medium.

The present invention provides a method of making an inkjet media having a porous hydrophilic polymer layer with improved surface characteristics.

Significantly smoother surfaces can be achieved with the method of the invention.

The method also produces better quality coating. As the blowing agents are prevented from being activated prior to the coating process there are no pre-formed bubbles passing down the hopper. As described earlier these pre-formed bubbles cause lines, streaks and edge retraction so the coating quality is improved using the method of the invention.

BRIEF DESCRIPTION OF THE DRAWINGS

The invention will now be described, by way of example, with reference to the accompanying drawings, in which.

DETAILED DESCRIPTION OF THE INVENTION

Figure 1:
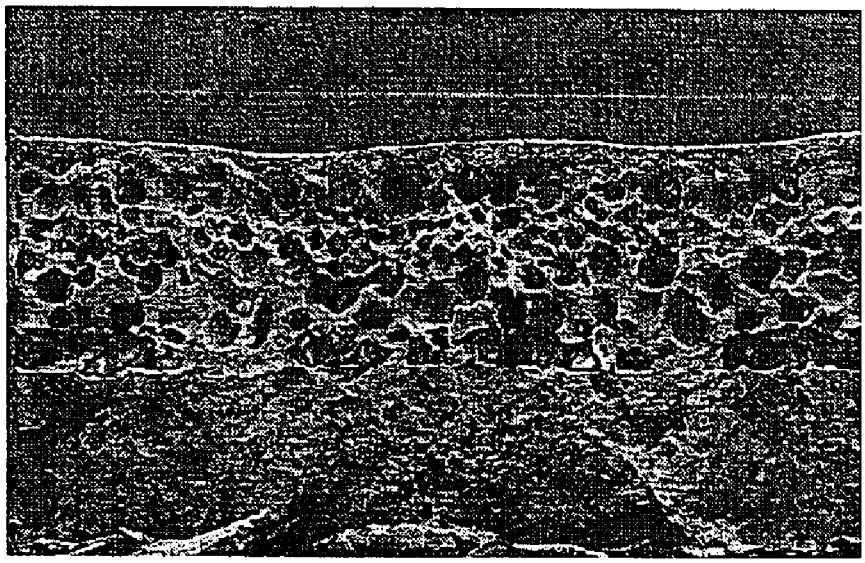
FIG. 1 is a scanning electron micrograph of a section through an inkjet receiver showing the bubble formation in an ink receiving layer formed with coating A as described below.

The present invention provides a method of making a material. The material may have many different uses, including use as an inkjet medium.

The medium comprises a support layer, such as resin coated paper, PET film base, acetate, printing plate or any other suitable support, and a polymeric layer supported on the support layer.

The polymeric layer comprises a hydrophylic polymer. Examples could include polyvinyl alcohol, polyethylene oxide, polyvinyl pyrrolidone and gelatin.

The polymeric layer is created by the use of blowing agents. Examples of suitable blowing agents include a mixture of sodium nitrite and ammonium chloride, metal carbonates and bicarbonates. Further examples of suitable blowing agents are described in, for example, the Handbook of Polymeric Foams and Foam Technology, edited by Daniel Klempner and Kurt C.Frisch, Chapter 17: Blowing Agents for Polymer Foams, Section 3 Chemical Blowing Agents (chapter written by Dr. Fyodor A.Shutov). Heat causes the blowing agents to decompose and create gas bubbles within the solution which causes foaming of the polymer. The foam is effectively a network of either open or closed cell arrangements of voids within a polymer matrix. Full details of such an inkjet medium are disclosed in U.S. patent application Ser. No. 10/631,236.

If the blowing agents are added to the coating solution prior to coating it is possible that gas bubbles can form prior to coating. Whether or not bubbles are formed depends on the temperature required for initiation of the decomposition of the blowing agent or agents and the pH of the solution. When gas bubbles are present in the melt and therefore in the coating solution it has been found that they can act as nucleation sites for other bubbles to form around when the blowing agents decompose vigorously in the drying section of the coating track. This results in quite rough surfaces on the inkjet receiver. Coating quality can also be affected when the pre-formed bubbles pass down the hopper, causing lines, streaks and edge retraction.

It has been found that if the blowing agents are dual melted into one of the layers at the hopper there is not enough time or heat available for the blowing agents to begin to decompose before the coating process begins. Therefore no bubbles are pre-formed, the bubbles not beginning to form until the coating solution containing the blowing agents passes into the dryers where the heat can initiate the gas formation. As there are no pre-formed bubbles to act as nucleation sites for new bubbles to form around significantly smoother surfaces can be achieved on the inkjet medium. The coating quality is also improved due to there being no pre-formed bubbles in the melts.

If two or more components are required for initiation of decomposition of the blowing agents the prevention of any pre-formed bubbles can also be achieved by adding one of the components to the melts prior to coating and dual melting the other one or more at the hopper. This method prevents the components being able to react until they all come together in the hopper. A further method of achieving prevention of initiation of decomposition is to add each component required to a separate layer of the coating. Once again, this method prevents the components being able to react until all the layers are coated together.

It has been shown that improved surface quality and coating quality can be achieved by preventing the initiation of the decomposition of the blowing agents prior to coating.

The following example demonstrates the invention.

EXAMPLE

A resin-coated paper support was coated on the front with three ink-receiving layers. Each layer comprised polyvinyl alcohol (PVA), blowing agents (a total of 50% by weight compared to the PVA laydown) and some surfactant.

Coating A was a control coating in which the blowing agents were added directly to the melts prior to coating.

In coating A the ink-receiving layer nearest the support consisted of 5.7 g/m$^2$ of PVA, 1.61 g/m$^2$ of sodium nitrite, 1.24 g/m$^2$ of ammonium chloride and 0.106 g/m$^2$ of surfactant. The middle ink-receiving layer consisted of 6.2 g/m$^2$ of PVA, 1.75 g/m$^2$ of sodium nitrite, 1.35 g/m$^2$ of ammonium chloride and 0.212 g/m$^2$ of surfactant. The top ink-receiving layer consisted of 7.1 g/m$^2$ of PVA, 2.00 g/m$^2$ of sodium nitrite, 1.55 g/m$^2$ of ammonium chloride and 0.318 g/m$^2$ of surfactant. Therefore the total PVA laydown of the entire coating pack was 19.0 g/m$^2$ and the total laydown of the blowing agents was 9.5 g/m$^2$. The three layers were then coated simultaneously on a bead-coating machine using a standard slide hopper.

Coating B was a coating where the blowing agents were dual melted into the top ink receiving layer at the hopper.

In coating B the ink-receiving layer nearest the support consisted of 6.4 g/m$^2$ of PVA and 0.106 g/m$^2$ of surfactant. The middle ink-receiving layer consisted of 7.2 g/m$^2$ of PVA and 0.212 g/m$^2$ of surfactant. The top ink-receiving layer consisted of 5.4 g/m$^2$ of PVA and 0.318 g/m$^2$ of surfactant. The blowing agents were then dual melted into the top ink receiving layer. The 40% sodium nitrite solution was dual melted using a laydown of 13.4 mls/m$^2$ (which is equivalent to 5.35 g/m$^2$ of sodium nitrite). The 20% ammonium chloride solution was dual melted using a laydown of 20.8 mls/m$^2$ (which is equivalent to 4.15 g/m$^2$ of ammonium chloride). Therefore the total PVA laydown of the entire coating pack was 19.0 g/m$^2$ and the total laydown of the blowing agents was 9.5 g/m$^2$ i.e. the same as for coating A. The three layers were then coated simultaneously on a bead-coating machine using a standard slide hopper.

To initiate the blowing process, the dryers inside the coating track were set to 90° C. through which the coating according to the present invention, coating B, and the control coating, coating A, were passed.

Figure 2:
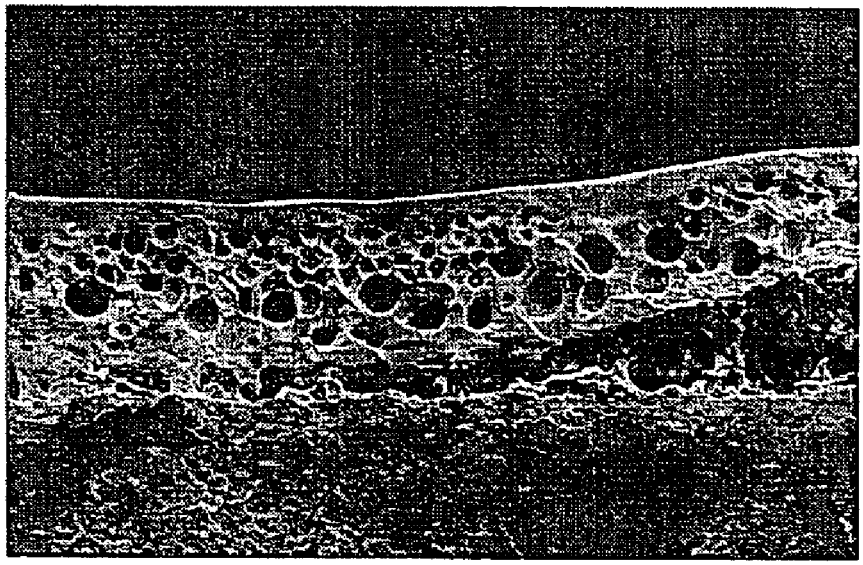
FIG. 2 is a scanning electron micrograph of a section through an inkjet receiver showing the bubble formation in an ink receiving layer formed with coating B as described below.

FIGS. 1 and 2 show scanning electron micrographs for coating A and coating B respectively. The figures indicate that bubble formation is unaffected by the method of addition of the blowing agents. This is important since the ink retention of the surface is therefore unaffected.

Table 1 shows the surface roughness measurement from both coating A and coating B. The table shows how the method of addition of the blowing agent effects the surface roughness of the resulting ink receiving layer.

TABLE 1

| Coating | Blowing Agent Addition Method | Rt (μm) | Rz (μm) | Rpm (μm) |
|---|---|---|---|---|
| A | Added to pots | 34.259 | 33.196 | 25.919 |
| B | Dual Melted | 25.816 | 22.423 | 12.666 |

Rt = Maximum value from peak to valley
Rz = Average peak to valley height
Rpm = Average height From the data in Table 1, it can be seen that significantly smoother surfaces are achieved when the blowing agents are dual melted (coating B) into one of the ink receiving layers at the hopper (indicated by lower roughness figures), compared to adding the blowing agents to the PVA melts prior to coating (coating A).

It can thus be seen that the method of addition of the blowing agents can affect the surface characteristics and coating quality of a foamed polymeric inkjet receiver. Both improved surface quality and coating quality can be achieved by preventing the activation of the blowing agent (s) until after coating has taken place.

It will be understood by those skilled in the art that the invention is not limited to use with bead coating. Any conventional coating method may be used.

It is to be understood that various modifications and changes may be made without departing from the present invention, the present invention being defined by the following claims.

What is claimed is:

1. A method of making a material comprising the steps of coating a support with a solution comprising a hydrophilic polymer and at least one blowing agent, activation of the blowing agent being prevented until after coating.

2. A method as claimed in claim 1 wherein the blowing agent is dual melted into the solution prior to coating.

3. A method as claimed in claim 1 wherein the blowing agent comprises at least two components, one component of which is incorporated into the solution comprising a hydrophilic polymer, the other component of which blowing agent is dual melted into the solution immediately prior to coating.

* * * * *